United States Patent [19]

Kimura et al.

[11] 4,157,260

[45] Jun. 5, 1979

[54] SCREEN PHOTOSENSITIVE BODY FOR ELECTROGRAPHIC APPARATUS

[75] Inventors: Katsuhiko Kimura; Kiyoshi Miyashita, both of Hachioji, Japan

[73] Assignee: Olympus Optical Co., Ltd., Tokyo, Japan

[21] Appl. No.: 834,850

[22] Filed: Sep. 19, 1977

[30] Foreign Application Priority Data

Sep. 24, 1976 [JP] Japan ..... 51/113758

[51] Int. Cl.[2] ..... G03G 5/04; G03G 15/00

[52] U.S. Cl. ..... 96/1.5 R; 355/3 SC; 140/24

[58] Field of Search ..... 96/1.5 R, 1.5 N; 355/3 SC; 140/24; 209/288

[56] References Cited

U.S. PATENT DOCUMENTS

| | | | |
|---|---|---|---|
| 2,096,767 | 10/1937 | Sklar | 140/24 X |
| 3,002,623 | 10/1961 | Fontaine | 209/288 |
| 3,898,085 | 8/1975 | Suzuki et al. | 96/1.5 R |
| 4,021,109 | 5/1977 | Tanaka et al. | 355/3 SC X |

FOREIGN PATENT DOCUMENTS

| | | | |
|---|---|---|---|
| 86488 | 5/1957 | Netherlands | 140/24 |

*Primary Examiner*—Roland E. Martin, Jr.
*Attorney, Agent, or Firm*—Haseltine, Lake & Water

[57] ABSTRACT

A photosensitive body for electrographic apparatus is disclosed. The photosensitive body is composed of a mesh-shaped photosensitive body and spread under tension around a pair of spaced apart supporting discs. The mesh-shaped photosensitive body is provided near at its opposed end edges with an elongate solid member. At least one of the solid members is secured through a tension spring to the supporting disc.

7 Claims, 9 Drawing Figures

SCREEN PHOTOSENSITIVE BODY FOR ELECTROGRAPHIC APPARATUS

BACKGROUND OF THE INVENTION

This invention relates to a photosensitive body for electrographic apparatus.

An electrographic apparatus which makes use of a mesh-shaped photosensitive body has heretofore been proposed. In such electrographic apparatus, the mesh-shaped photosensitive body is of four layer construction composed of an electrically conductive substrate having a number of openings, a photosensitive layer coated on one side of the substrate, an insulating layer coated on the other side of the substrate and an electrically conductive layer coated on the insulating layer. The mesh-shaped photosensitive body is uniformly charged and then exposed to a manuscript image so as to produce, on the mesh-shaped photosensitive body, a first electrostatic latent image corresponding to the manuscript image. Subsequently, a flow of corona ions is modulated on the basis of the first electrostatic latent image to produce, on an electrostatic record sheet, a second electrostatic latent image corresponding to the first electrostatic latent image. The second electrostatic latent image produced on the electrostatic record sheet is developed and fixed to obtain a visible image.

In such electrographic apparatus, in the case of producing, on the electrostatic record sheet, the second electrostatic latent image, a corona discharge electrode for emitting a flow of corona ions must be opposed through the mesh-shaped photosensitive body to the electrostatic record sheet. For this purpose, the mesh-shaped photosensitive body is required to be held at its margin on the outside of an effective picture surface range, for example, to be held at its end edges.

A drum-shaped photosensitive body has also been proposed in which a mesh-shaped photosensitive body is wound around a drum-shaped supporting frame and firmly secured thereto.

In this case, however, since the photosensitive body is of a mesh-shaped one, it is difficult to handle it. In addition, in the case of winding the mesh-shaped photosensitive body around the drum-shaped supporting frame, at first the mesh-shaped photosensitive body must be temporarily fastened to the drum-shaped supporting frame and then the end edges of the mesh-shaped photosensitive body must be pulled under tension so as to remove wrinkles existing thereon and subsequently the mesh-shaped photosensitive body must be permanently secured to the drum-shaped supporting frame, thereby involving very troublesome operations for the purpose of securing the mesh-shaped photosensitive body to the drum-shaped supporting frame.

It has also been proposed to secure a mesh-shaped photosensitive body to a drum-shaped supporting frame with the aid of a thin plate-shaped frame which is bonded with the end edge of the mesh-shaped photosensitive body and secured to the drum-shaped supporting frame by means of screws.

An attempt has also be made to provide a drum-shaped supporting frame composed of a pair of spaced apart supporting discs and to provide between these supporting discs an intermediate disc which is arranged movably in the axial direction of the drum-shaped supporting discs. In this case, thin plates bonded to the end edges of the mesh-shaped photosensitive body are secured to both the outer periphery of the intermediate disc and the outer periphery of one of the pair of the supporting discs and then the intermediate disc is displaced toward the other supporting disc such that the drum-shaped photosensitive body becomes spread under tension around the discs.

In all of these prior art mesh-shaped photosensitive bodies, the side edges or end edges of the mesh-shaped photosensitive body are bonded with the thin plate. As a result, if a bonding agent becomes irregular in thickness or if the mesh-shaped photosensitive body is not flat in the case of bonding the thin plate therewith, the photosensitive body tends to produce wrinkles when it is formed into a drum-shape, thus rendering the spreading operation very difficult.

Another attempt has been made to provide a groove formed along the outer periphery of a pair of spaced apart supporting discs for constituting a drum-shaped supporting frame. The supporting discs are surrounded by a mesh-shaped photosensitive body and then against the groove is urged a resilient ring such that the mesh-shaped photosensitive body becomes spread under tension in a closely tight manner. In this case, an electrically conductive substrate of the mesh-shaped photosensitive body is composed of a wire mesh formed of a wire having a diameter of 30 to 50$\mu$ or is composed of an etched foil having a thickness on the order of 30 to 50$\mu$. Such kind of wire mesh or etched foil has no flexibility which is sufficient to be deformed when it is spread under tension around the discs. As a result, it is impossible to spread under tension the photosensitive body around the supporting discs.

The drum-shaped photosensitive body composed of the mesh-shaped photosensitive body secured directly or through the thin plate to the drum-shaped supporting frame by means of the screws requires a plenty of operating time in the case of replacing the mesh-shaped photosensitive body by a new one or in the case of assembling it. In addition, in the above described various kinds of drum-shaped photosensitive bodies, the mesh-shaped photosensitive body is directly or through the thin plate secured to the supporting discs for constituting the drum-shaped supporting frame, so that there is a risk of the mesh-shaped photosensitive being wrinkled by the difference between the thermal expansion of the mesh-shaped photosensitive body and that of the drum-shaped supporting frame due to change in the surrounding temperature.

SUMMARY OF THE INVENTION

An object of the invention, therefore, is to provide a photosensitive body composed of a mesh-shaped photosensitive body, which can eliminate the above described various drawbacks which have been encountered with the prior art techniques and which can improve the flatness of the mesh-shaped photosensitive body.

A main feature of the invention is the provision of a photosensitive body for electrographic apparatus, comprising a mesh-shaped photosensitive body and an elongate solid member formed at near both end edges of said mesh-shaped photosensitive body and made integral therewith, said elongate solid member preventing said mesh-shaped photosensitive body from being deformed.

The invention will now be described in greater detail with reference to the accompanying drawings.

DESCRIPTION OF THE PREFERRED EMBODIMENTS

Figure 1:
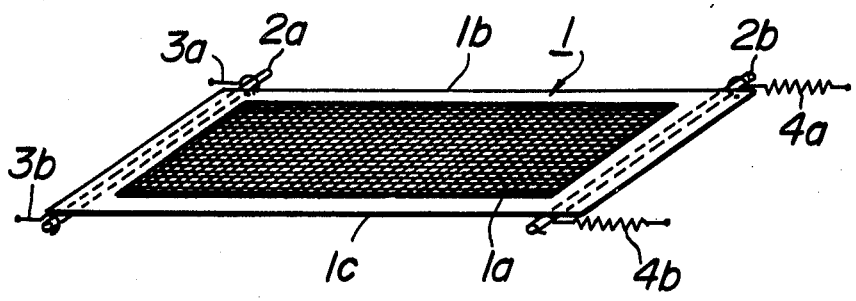
FIG. 1 is a perspective view of one embodiment of a photosensitive body according to the invention in its flat state.

In FIG. 1 is shown one embodiment of a photosensitive body according to the present invention. A mesh-shaped photosensitive body 1 is composed of a mesh-shaped electrically conductive substrate having a number of openings, insulating layers coated on those both sides of the substrate which are located on an effective picture surface region 1*a*, a photosensitive layer coated on one of the insulating layers and an electrically conductive layer coated on the other insulating layer. To the marginal space located outside the effective picture surface range 1*a* of the mesh-shaped photosensitive body 1 and near the end edges thereof are secured bar-shaped solid members 2*a*, 2*b* made integral therewith and each having a length which is slightly longer than that of the end edge of the mesh-shaped photosensitive body 1.

In the case of spreading under tension the photosensitive body 1 around a drum-shaped frame which will be described with reference to FIG. 6, one of the bar-shaped solid member 2*a* is secured through hooks 3*a*, 3*b* to the drum-shaped frame and the other bar-shaped solid member 2*b* is connected through tension springs 4*a*, 4*b* to the drum-shaped frame. The hooks 3*a*, 3*b* and tension springs 4*a*, 4*b* are connected to those portions of the bar-shaped solid members 2*a*, 2*b* which are projected out of the mesh-shaped photosensitive body 1.

Figure 2:
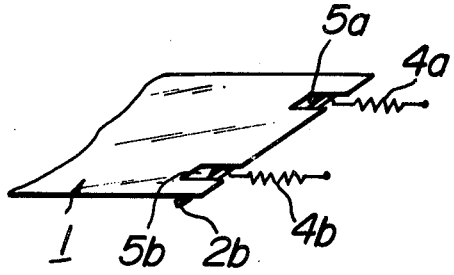
FIG. 2 is a partial perspective view of another embodiment of a photosensitive body according to the invention.

In FIG. 2 is shown another embodiment of a photosensitive body according to the invention. In the present embodiment, the length of the bar-shaped solid member 2*b* is made substantially equal to that of the end edge of the mesh-shaped photosensitive body 1. In addition, the mesh-shaped photosensitive body 1 is provided at that end edge to which is secured the bar-shaped member 2*b* with notches 5*a* and 5*b* spaced apart from each other and exposing two portions of the bar-shaped solid member 2*b*. With these exposed portions of the bar-shaped solid member 2*b* are engaged tension springs 4*a*, 4*b*, respectively. Similarly, the mesh-shaped photosensitive body 1 may be provided at that end edge to which is secured the bar-shaped solid member 2*a* with similar notches so as to expose two portions of the bar-shaped solid member 2*a*. The hooks 3*a*, 3*b* may then be engaged with these exposed portions of the bar-shaped solid member 2*a*.

In the photosensitive body shown in FIGS. 1 and 2, if the centers of the bar-shaped solid members 2*a*, 2*b* are not aligned with the plane of the mesh-shaped photosensitive body 1, the end edges of the mesh-shaped photosensitive body 1 spread under tension by the hooks 3*a*, 3*b* and tension springs 4*a*, 4*b* tend to be turned up due to a torque subjected thereto and for bringing the centers of the bar-shaped solid members 2*a*, 3*b* into agreement with the plane of the mesh-shaped photosensitive body 1. In order to prevent such drawback, it is desirous to substantially align acting points and lines of the hooks 3 and tension springs 4 with the plane of the mesh-shaped photosensitive body 1.

Figure 4A:
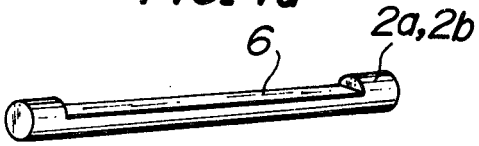
FIG. 4*a* is a perspective view of one embodiment of a bar-shaped solid member made integral with a photosensitive body according to the invention.

In FIG. 4*a* is shown one embodiment of a bar-shaped solid member which can prevent the above mentioned disagreement. In the present embodiment, that portion 6 of the bar-shaped solid member 2*a*, 2*b* which is not engaged with the hooks 3*a*, 3*b* and tension springs 4*a*, 4*b* and to which is secured the mesh-shaped photosensitive body 1 is made semicircular in section.

Figure 4B:
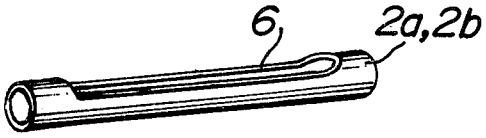
FIG. 4*b* is a perspective view of a modified form of the bar-shaped solid member shown in FIG. 4*a;*

In FIG. 4*b* is shown a modified embodiment of the bar-shaped solid member shown in FIG. 4*a*. In the present embodiment, the bar-shaped solid members 2*a*, 2*b* are composed of a bar-shaped hollow cylinder and that portion 6 thereof to which is secured the mesh-shaped photosensitive body 1 is also made semi-circular in section.

Figure 5:
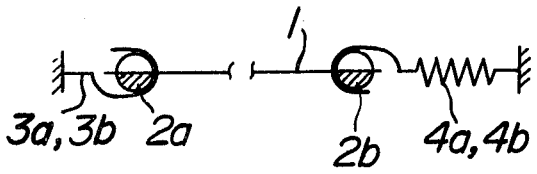
FIG. 5 is a schematic diagram illustrating the mode of aligning the plane of a mesh-shaped photosensitive body with the bar-shaped solid members shown in FIGS. 4*a* and 4*b;*

As shown in FIG. 5, the use of the solid members 2*a*, 2*b* shown in FIGS. 4*a*, 4*b* renders it possible to substantially align respective centers with the plane of the mesh-shaped photosensitive body 1 and provides the advantage that the mesh-shaped photosensitive body 1 can be made flat when it is spread under tension without inducing the above mentioned drawback.

Figure 6:
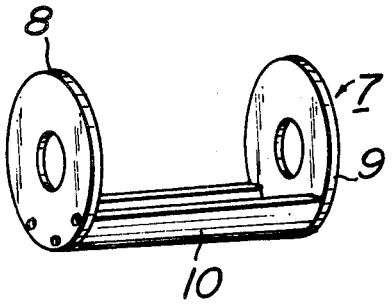
FIG. 6 is a perspective view of a drum-shaped supporting discs used in the case of spreading under tension a photosensitive body according to the invention therearound.

In FIG. 6 is shown a drum-shaped frame 7 adapted to spread under tension therearound the mesh-shaped photosensitive body into a drum-shaped one with its photosensitive layer faced outwardly. The drum-shaped frame 7 is composed of a pair of spaced apart insulating discs 8, 9 and a segment-shaped insulating connection member 10 for connecting opposed inner peripheral surfaces of the discs 8, 9 with each other.

Figure 3:
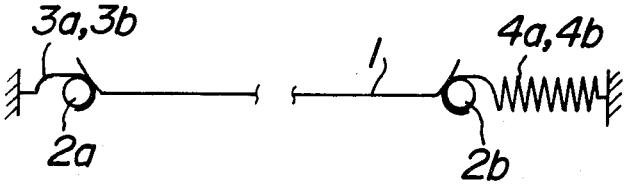
FIG. 3 is a schematic diagram illustrating the mode of turning up the end edges of a photosensitive body when its plane is not aligned with the center of a bar-shaped solid member.
Figure 7A:
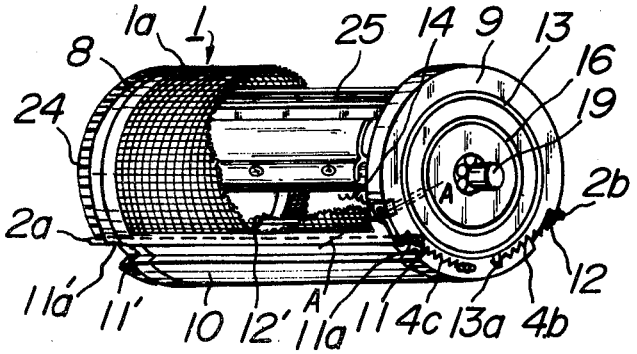
FIG. 7*a* is a perspective view of a drum-shaped photosensitive body as constructed by spreading under tension a photosensitive body according to the invention around the drum-shaped discs shown in FIG. 6, a part being broken away to show interior parts.
Figure 7B:
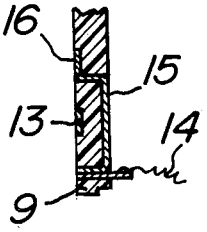
FIG. 7*b* is a section on line A—A of FIG. 7*a;*

In FIGS. 7*a* and 7*b* is shown a drum-shaped photosensitive body formed by spreading under tension the mesh-shaped photosensitive body 1 around the drum-shaped frame 7 shown in FIG. 6. As shown in FIG. 7*a*, the disc 9 is provided along its periphery with two grooves 11, 12 distant apart from each other. Similarly, the disc 8 is also provided with two grooves 11', 12' opposed to the grooves 11, 12, respectively. Into these grooves 11, 11' is inserted the bar-shaped solid member 2*a* whose projected ends are secured to and made integral with the groove walls 11*a*, 11′*a*, respectively. Then, the mesh-shaped photosensitive body 1 is wound around both the discs 8 and 9 and the other bar-shaped solid member 2*b* is inserted into the grooves 12, 12′. One end of the bar-shaped solid member 2*b* is connected through a tension spring 4*b* to a projection 13*a* of an electric supply ring 13 provided on the outside surface of the disc and the other end of the bar-shaped solid member 2*b* is connected through a tension spring 4*a* (not shown) to the disc 8. It is a matter of course that the grooves 12, 12′ of the discs 9, 8 should be made slightly wider than the grooves 11, 11′ of the discs 9, 8 for the purpose of permitting the tension springs 4*b*, 4*a* to effectively act upon the disc 9. In addition, the action lines of the tension springs 4*a*, 4*b* are possibly made aligned with the plane of the photosensitive body 1 in order to prevent the end edges of the photosensitive body 1 from being turned up as shown in FIG. 3. Reference numeral 25 designates a corona discharge electrode arranged inside the mesh-shaped photosensitive body 1 and secured to that portion of a fixed shaft 19 which is located between the discs 8, 9.

In the case of winding the mesh-shaped photosensitive body 1 around the discs 8, 9, care must be taken that the effective picture surface range 1*a* of the photosensitive body 1 should not cover the discs 8, 9.

Figure 8:
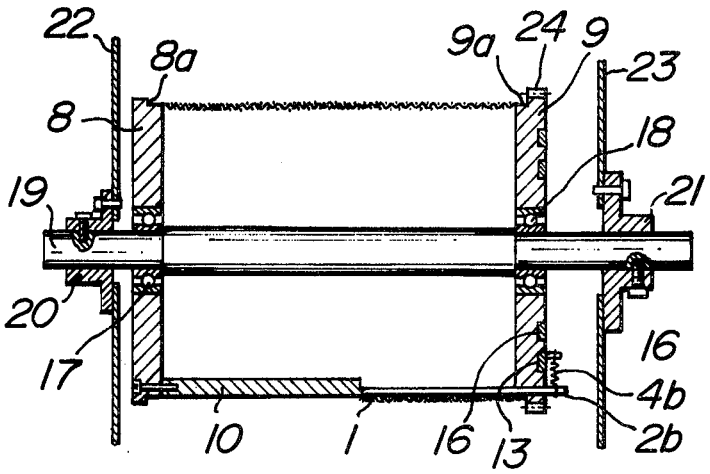
FIG. 8 is a longitudinal sectional view of the drum-shaped photosensitive body shown in FIGS. 7*a* and 7*b* and mounted on an electrographic apparatus.

In FIG. 8 is shown the drum-shaped photosensitive body shown in FIGS. 7*a* and 7*b* and mounted on an electrographic apparatus. As shown in FIG. 8, both the discs 8 and 9 are provided along the periphery thereof with steps 8*a* and 9*a* each having a width which is sufficient to allow displacement of the mesh-shaped photosensitive body 1 in its widthwise direction when it is thermally expanded. In addition, at least the tension spring 4*b* for connecting the bar-shaped solid member 2*b* to the disc 9 is made electrically condutive and is electrically connected to the electric supply ring 13 for the purpose of easily applying a voltage across the electrically conductive substrate and the electrically conductive layer of the mesh-shaped photosensitive body 1. For this purpose, a lead wire 14 electrically connected to the electrically conductive layer is connected through an electrically conductive metal strip 15 embedded in the insulating disc 9 to a second electric supply ring 16 provided on the outside surface of the disc 9 as clearly shown in FIG. 7*b*.

As shown in FIG. 8, the drum-shaped photosensitive body constructed as above described is rotatably mounted through bearings 17, 18 on the fixed shaft 19 having ends secured through brackets 20, 21 to side walls 22, 23 of the electrographic apparatus. The disc 9 is provided at its outer periphery with a gear 24 which is geared with a driving gear (not shown) and makes it possible to rotate the drum-shaped photosensitive body 1 about the fixed shaft 19. The electric supplying rings 13, 16 may be connected through slidable brushes (not shown) secured to the side wall 23 to the electrically conductive substrate and electrically conductive layer of the mesh-shaped photosensitive body 1, respectively, thus enabling to apply a voltage therebetween.

Figure 9:
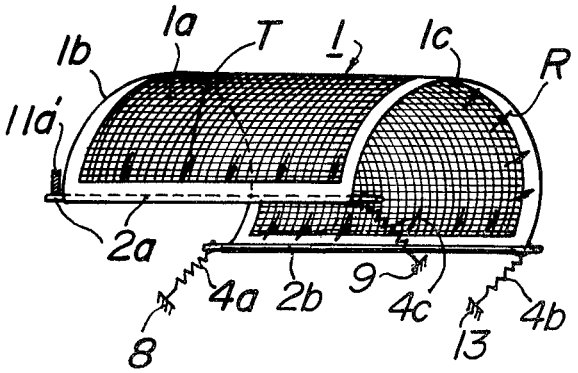
FIG. 9 is a perspective view of a modified embodiment of the drum-shaped photosensitive body shown in FIG. 7*a.*

In FIG. 9 is shown a modified embodiment of the mesh-shaped photosensitive body shown in FIG. 7*a*. In the present embodiment, both ends of the bar-shaped solid member 2*b* are connected through the tension springs 4*a*, 4*b* to the discs 8, 9 and one end of the bar-shaped solid member 2*a* is secured to the groove wall 11′*a* as shown in FIG. 7*a*, but the other end of the bar-shaped solid member 2*a* is connected through a third tension spring 4*c* to the disc 9 as shown in FIG. 9.

The mesh-shaped photosensitive body 1 shown in FIG. 9 is subjected to a reaction force acting in a radial direction as shown by an arrow R and to a tensile force acting in a circumferential direction as shown by an arrow T. But, both the end edges of the mesh-shaped photosensitive body 1 are made solid by the bar-shaped solid members 2*a*, 2*b*, so that the tensile force T acting along the overall width thereof becomes uniform. In addition, both the side edges 1*b*, 1*c* of the photosensitive body 1 are homogeneous with the center portion thereof, so that the reaction force R functions to spread the photosensitive body 1 under tension with a constant radius of curvature maintained with respect to the center axis thereof, thereby forming a uniform photosensitive surface.

In addition, all of the ends of the bar-shaped solid members 2*a*, 2*b* except one end of the bar-shaped solid member 2*a* are resiliently movable, so that it is possible to prevent the mesh-shaped photosensitive body 1 from becoming unbalanced when it is spread under tension around the discs 8, 9. The use of the tension springs 4*a*, 4*b*, 4*c* ensures a good effect of absorbing unbalance of the internal stress of the mesh-shaped photosensitive body and hence of uniformly spreading under tension it around the discs 8, 9. Moreover, both the side edges 1*b*, 1*c* freely supported by the discs 8, 9 function to maintain the mesh-shaped photosensitive body 1 under uniform tension irrespective of the thermal expansion thereof and the exterior force subjected thereto. In the case of winding the mesh-shaped photosensitive body 1 around the discs 8, 9, care must be taken that the effective picture surface range 1*a* should not be superimposed about the connection member 10. It is a matter of course that the bar-shaped solid member 2*b* and the tension spring 4*b* should be made electrically conductive so as to connect them through the electric supply ring 13 to the electrically conductive substrate of the mesh-shaped photosensitive body 1.

As stated hereinbefore, the mesh-shaped photosensitive body according to the invention comprises an elongate solid member formed at each end edge thereof and made integral therewith, so that it is possible to prevent the mesh-shaped photosensitive body from becoming easily deformed. In addition, in the case of winding the photosensitive body around the drum-shaped frame and securing the former through the elongate solid members to the latter, at least one of the elongate solid members is secured through a resilient member to the latter, and as a result, the mesh-shaped photosensitive body can be spread under tension around the drum-shaped frame. Even in the case of spreading under tension the photosensitive body around the drum-shaped frame, it is not necessary to secure the end edges of the photosensitive body to the outer periphery of the drum-shaped frames by means of screws. As a result, assembling of the drum-shaped photosensitive body and replacement of the mesh-shaped photosensitive body for a new one may easily be carried out. Since the photosensitive body is not firmly secured to the drum-shaped frame, the difference between the thermal expansion of the photosensitive body and that of the drum-shaped frame does not induce wrinkles in the photosensitive body. In addition, there is no risk of the photosensitive body being subjected to unreasonable internal stress. Moreover, the elongate solid member functions as an electrode for the electrically conductive substrate of the photosensitive body and hence provides a material decrease in number of parts.

The invention is not limited to the embodiments described above and many alternations and modifications may be made. For example, the elongate solid member may be formed by coiling an end edge of the electrically conductive substrate of the mesh-shaped photosensitive body into several turns.

What is claimed is:

1. A drum-shaped photosensitive body for an electrographic apparatus, comprising: a drum-shaped frame (7); a mesh-shaped photosensitive body (1) spread under tension around said drum-shaped frame and having opposed circumferential side edges, said circumferential side edges extending circumferentially along said drum-shaped frame so as to be extensible along said drum-shaped frame; a supporting member formed by first and second elongated bar-shaped solid members (2*a*, 2*b*) secured near opposed end edges of said mesh-shaped photosensitive body 1, said supporting member being operative for supporting said mesh-shaped photosensitive body to prevent it from deforming; and a resilient member (4*a*, 4*b*) connected to at least one of said elongated bar-shaped solid members to spread said mesh-shaped photosensitive body under tension around said drum-shaped frame.

2. A drum-shaped photosensitive body according to claim 1, wherein: said bar-shaped solid member is of a length equal to that of the end edge of said mesh-shaped photosensitive body.

3. A drum-shaped photosensitive body according to claim 1, wherein: said bar-shaped solid member is of a length longer than that of the end edge of said mesh-shaped photosensitive body.

4. A drum-shaped photosensitive body according to claim 1, wherein: a first of said bar-shaped solid members is directly engagable with said drum-shaped frame and the second bar-shaped solid member is engagable through said resilient member with said drum-shaped frame.

5. A drum-shaped photosensitive body according to claim 1, wherein: said mesh-shaped photosensitive body is provided at portions near the end edges thereof, with notch means for exposing portions of said bar-shaped solid member.

6. A drum-shaped photosensitive body according to claim 5, wherein: said notch means is engaged to one end of said resilient member, the other end of said resilient member being engaged with said drum-shaped frame.

7. A drum-shaped photosensitive body according to claim 1, wherein: said mesh-shaped photosensitive body is provided at that plane which is subjected to tension of said resilient member with said supporting member.

* * * * *